US005803306A

United States Patent [19]

Lewis

[11] Patent Number: 5,803,306

[45] Date of Patent: Sep. 8, 1998

[54] NOVELTY CUP

[75] Inventor: Stuart A. Lewis, Syosset, N.Y.

[73] Assignee: High Point Accessories, Inc., New York, N.Y.

[21] Appl. No.: 783,274

[22] Filed: Jan. 15, 1997

[51] Int. Cl.[6] ..... B65D 65/00

[52] U.S. Cl. ..... 220/662; 220/703

[58] Field of Search ..... 220/703, 574, 220/662, 669, 694, 469; 215/6; 446/74; 206/217

[56] References Cited

U.S. PATENT DOCUMENTS

| | | | |
|---|---|---|---|
| D. 161,459 | 1/1951 | Karmen . | |
| D. 169,370 | 4/1953 | Greenspan . | |
| D. 251,226 | 3/1979 | Danat et al. . | |
| D. 314,308 | 2/1991 | Cogswell . | |
| 2,689,424 | 9/1954 | Clagett . | |
| 3,069,046 | 12/1962 | Gram . | |
| 4,263,734 | 4/1981 | Bradshaw . | |
| 4,932,542 | 6/1990 | Chen et al. . | |
| 5,029,700 | 7/1991 | Chen . | |
| 5,031,803 | 7/1991 | Chen . | |
| 5,050,757 | 9/1991 | Hidding et al. . | |
| 5,105,940 | 4/1992 | Chen . | |
| 5,351,851 | 10/1994 | Powell | 220/662 X |
| 5,419,436 | 5/1995 | Powell . | |
| 5,511,685 | 4/1996 | Nelson | 220/662 |
| 5,553,735 | 9/1996 | Kimura | 220/469 |

*Primary Examiner*—Steven M. Pollard
*Attorney, Agent, or Firm*—Hoffmann & Baron, LLP

[57] ABSTRACT

A fluid containing device includes an outside wall with an inwardly directed concavity formed therein. The device also includes a selectively removable scene display which is fitted in said concavity formed in the outside wall of the device. The concavity includes a base portion for selective receipt of at least one feature of said scene display. The base portion and the at least one feature can be provided with elements of a dovetail slide arrangement such that a male portion of the dovetail engages a female portion whereby the at least one feature can be selectively removed from the concavity when desired. The scene display includes at least one figure and/or at least one scenery element which are selectively removable from the scene display. The device further preferably includes a pictorial portion having an attachment for selective fixation to a receiving portion formed on the cup.

11 Claims, 3 Drawing Sheets

NOVELTY CUP

BACKGROUND OF THE INVENTION

The present invention relates generally to fluid containing devices, and, more particularly, to fluid containing devices which have novelty features.

It is generally believed that children's interest in consuming liquids is heightened if the container holding the liquid includes some type of entertaining and/or aesthetic feature, e.g., picture, text, game, etc. Such features occupy children's attention so that they will consume the liquid in the container. Furthermore, from a product marketing point of view, containers having such entertaining and/or aesthetic features are more readily purchased, since the features attract a child's attention to the container located on a store shelf which, in turn, more often than not, leads to a parent purchasing the container to appease the child. Thus, containers having novelty features have been developed over the years.

For instance, U.S. Pat. No. 2,689,424 to Clagett discloses a dual-indicia container which displays one facial expression (e.g., frowning clown) when the container is substantially filled with a liquid and displays another facial expression (e.g., smiling clown) when the container has been emptied of the liquid.

Further, U.S. Pat. No. 5,419,436 to Powell discloses a molded cup with an upwardly directed article receiving area on the bottom surface of the cup for receiving an article therein. The cup also includes a transparent cover provided over the receiving area which normally retains the article. The transparent cover may be separated from the cup in order to remove the article contained in the receiving area. The article to be stored in the receiving area is illustrated as a figurine. However, unless the figurine is removed from the receiving area on the bottom of the cup, the child is unable to easily view the figurine when there is liquid in the cup. Even so, removing the figurine from the cup prior to filling it with liquid reverts the cup to an ordinary drinking container, void of any entertaining features.

Still further, U.S. Pat. No. 4,932,542 to Chen et al. discloses a beverage container having a sidewall body with a projection extending inwardly from the internal wall of the sidewall body. Further, the container includes a cavity extending inwardly from the external wall surface of the sidewall body into the projection with an opening located at the external wall surface. A rotatable ornament (e.g., a transparent, hollow ball which is half-filled with water and has a sailboat floating therein) is rotatably and non-removably mounted in the cavity of the sidewall body whereby a portion of the ornament protrudes from the opening in the sidewall body. U.S. Pat. Nos. 5,029,700 and 5,105,940, also to Chen, disclose similar drinking cups but such cups have fixed interactive games mounted thereon.

Lastly, United Kingdom Design Patent No. 2,042,479 discloses a drinking cup with a miniature character mounted in a recess formed in the sidewall of the cup. The character is permanently mounted (e.g., glued) in the recess of the cup.

While each of the containers described above are designed to attract and entertain the user, it is an object of the present invention to provide a uniquely improved liquid vessel with novelty features which are removable and which may be interchanged with different features.

SUMMARY OF THE INVENTION

The present invention is a fluid containing device which includes an outside wall, preferably a sidewall, and at least one inwardly directed concavity for containing a scene display formed in the outside wall. The device of the present invention also includes scene display features which selectively fit in the concavity formed in the outside wall.

In a preferred embodiment, the concavity includes a base portion and at least one scene display feature includes a mating portion. The mating portion of the scene display feature engages the base portion of the concavity such that the scene display feature is selectively removable from the concavity. Preferably, the base portion and the mating portion form a dovetail slide arrangement whereby the base portion preferably forms the male slide member of the arrangement, while the mating portion forms the female slide member, which is shaped to slidably receive the male member. Of course, in an alternative embodiment, the base portion may form the female slide member with the mating portion forming the male slide member. Other engaging arrangements can be employed to provide the removable feature without departing from the spirit of the invention.

The scene display feature preferably includes at least one figure, e.g., a person or animal. However, it is within the scope of the present invention for the scene display to also include scenery elements, such as rock formation(s), shrubbery, etc. Moreover, one or more figures can be mounted on scenery elements. Figure(s) can be selectively detachable from scenery elements. Preferably, posts formed on the bottom of the figures may be inserted into openings formed on the scenery elements in order to provide selective mounting of the figures on the scenery elements.

Other scene display features can be fitted into the concavity. For example, a pictorial portion can be provided with an attachment for selective fixation to a receiving portion formed in the wall of the container. In this manner, the pictorial portion can also be selectively received by and removed from the receiving portion. The attachment of the pictorial portion and the receiving portion preferably form a tongue and groove arrangement whereby the attachment forms the tongue member and the receiving portion forms the groove member. Alternatively, the attachment can form the groove member while the receiving portion forms the tongue member. The pictorial portion can be, for example, a representation of a waterfall which aesthetically complements characters provided in other scene display features fitted in the concavity.

The fluid containing device may also preferably have a fixed pictorial portion, which complements the selectively removable pictorial portion, formed on the outside wall of the container including the concavity. Also, a stand may preferably be formed on the bottom of the container having a shape substantially similar to a cross-sectional profile of a fluid containing area of the container. In this way, a first container may be stacked substantially flush on top of a second container.

As a result, the present invention provides a fluid containing device (e.g., a drinking cup) including improved entertainment and/or aesthetic characteristics, i.e., scene displays such as characters, landscape and pictorial features, which are readily viewable by the holder of the device. Further, such features are selectively removable which advantageously permits the user to interchange different features. The interchangeability of features also has the advantage of simplifying the manufacture of various entertainment and/or aesthetic embodiments of the device, since one type of base container may be formed which can be fitted with various figure and scenery combinations to form a variety of final products.

For better understanding of the present invention, together with other and further objects and advantages, reference is made to the following description, taken in conjunction with the accompanying drawings, and its scope will be pointed out in the appended claims.

DETAILED DESCRIPTION OF THE PREFERRED EMBODIMENTS

Figures 1, 2, 3:
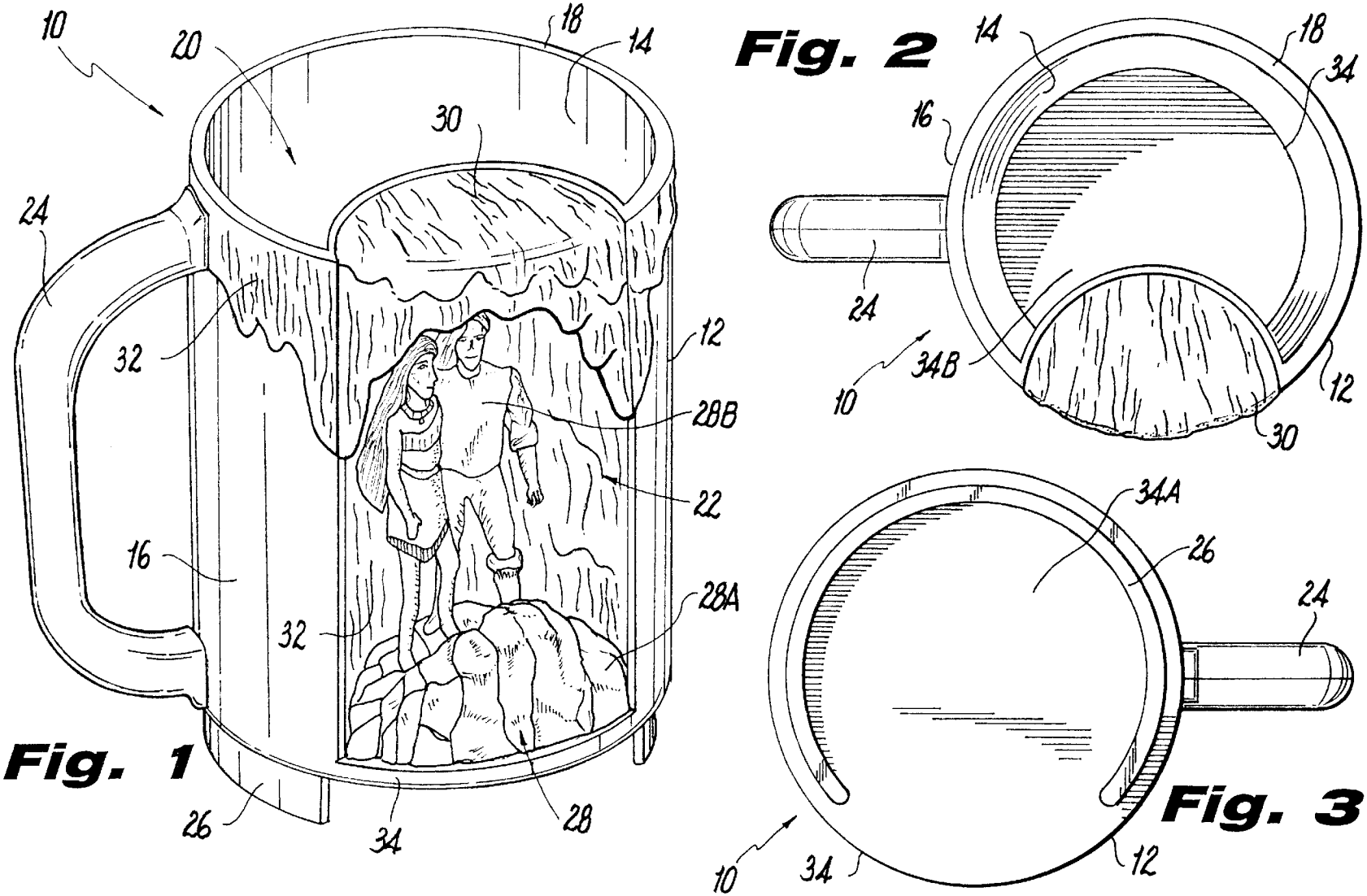
FIG. 1 is a perspective view of a preferred embodiment of a novelty cup of the present invention.
FIG. 2 is a top plan view of the inventive novelty cup.
FIG. 3 is a bottom plan view of the inventive novelty cup.

Referring to the drawings, a preferred form of a fluid containing device 10 of the present invention is shown. Particularly, the fluid containing device 10 is shown in the form of a drinking cup or mug; however, the present invention contemplates various other shapes of fluid holding containers formed in accordance with the inventive teachings described herein. For example, but in no way limited thereto, the fluid containing device may be formed in the shape of a bowl or possibly even a drinking glass-like container (e.g., fluid container having no handle).

Referring initially to FIGS. 1 through 4, the cup 10 has a sidewall body 12 which includes an inner surface 14, an outer surface 16 and an upper lip 18 which, along with bottom wall body 34 as shown in FIG. 2, defines a substantially circular-shaped fluid containing area 20. The sidewall body 12 has an inwardly directed concavity 22 formed therein. As shown in FIG. 2, the concavity 22 has a generally arc-shaped top plan view cross-section which, due to its inwardly directed orientation, impinges into the fluid containing area 20. Thus, the fluid containing area 20 is modified by inwardly oriented concavity 22.

A handle 24 is formed on the outer surface 16 of the sidewall body 12. The particular shape of the handle 24 is not critical to the present invention and, therefore, may be formed in various shapes. Also, a cup stand 26 is formed on a bottom surface 34A of the bottom wall body 34, as best shown in FIG. 3. Preferably, the shape of the stand 26 is substantially similar to that of the upper lip 18 of the sidewall body 12, with the exception that an outer diameter associated with the stand 26 is slightly smaller than an inner diameter associated with the upper lip 18. In this manner, a first cup may be stacked on top of a second cup such that the stand 26 of the first cup fits within the fluid containing area 20 of the second cup and the portion of the bottom surface 34A of the bottom wall body 34, located outside of the stand 26 of the first cup, rests substantially flush on the upper lip 18 of the second cup when the handles 24 of both cups are facing in the same direction. Such a complementary formation of the stand 26 and the upper lip 18 is particularly useful in shipping and/or storing a number of cups.

The cup 10 also includes a scene display feature 28 which is removably mounted within the concavity 22. The scene display 28 is preferably composed of a scenery element 28A and FIGS. 28B. As exemplified in the drawings, the scenery element 28A is a rock formation, while the FIGS. 28B are two persons standing side by side, i.e., a man and a woman. However, it is to be understood that the scene display feature 28 may include various other scenery elements (e.g., water, grass, foliage, etc.) and/or figures (a human character, an animal or animals, etc.).

An additional pictorial portion 30 is also included as part of the assembly. The pictorial portion 30 has been provided at the top of the concavity 22 and, similar to the scene display 28, is removably mounted on the cup 10 (the pictorial portion can also be made a permanent fixture by cementing it in place with an adhesive). As shown in the embodiment depicted in the drawings, the pictorial portion 30 is a waterfall; however, like the scene display 28, it is not limited to such a representation. The pictorial portion 30 complements the scene display 28 so as to form a complete visual display which is entertaining and/or aesthetically pleasing to someone drinking from the cup 10. An additional pictorial 32 and 22 (e.g., water from a waterfall), which complements the removable pictorial portion 30, can be formed on the cup 10, preferably, where the outer surface 16 and the upper lip 18 meet, as well as on the portion of the outer surface 16 which forms the back of the concavity.

Figure 5:
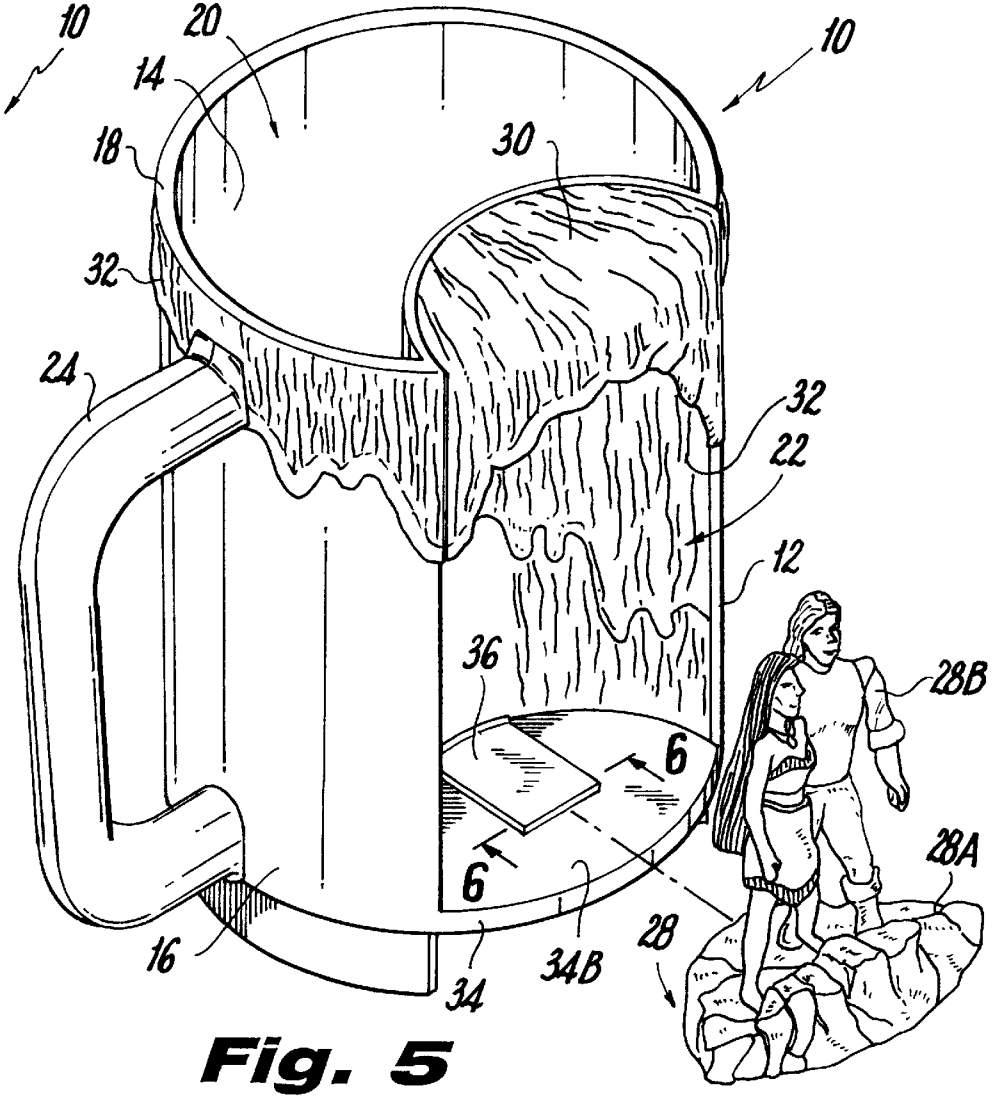
FIG. 5 is a perspective partially exploded view of the components of the inventive novelty cup.
Figure 4:
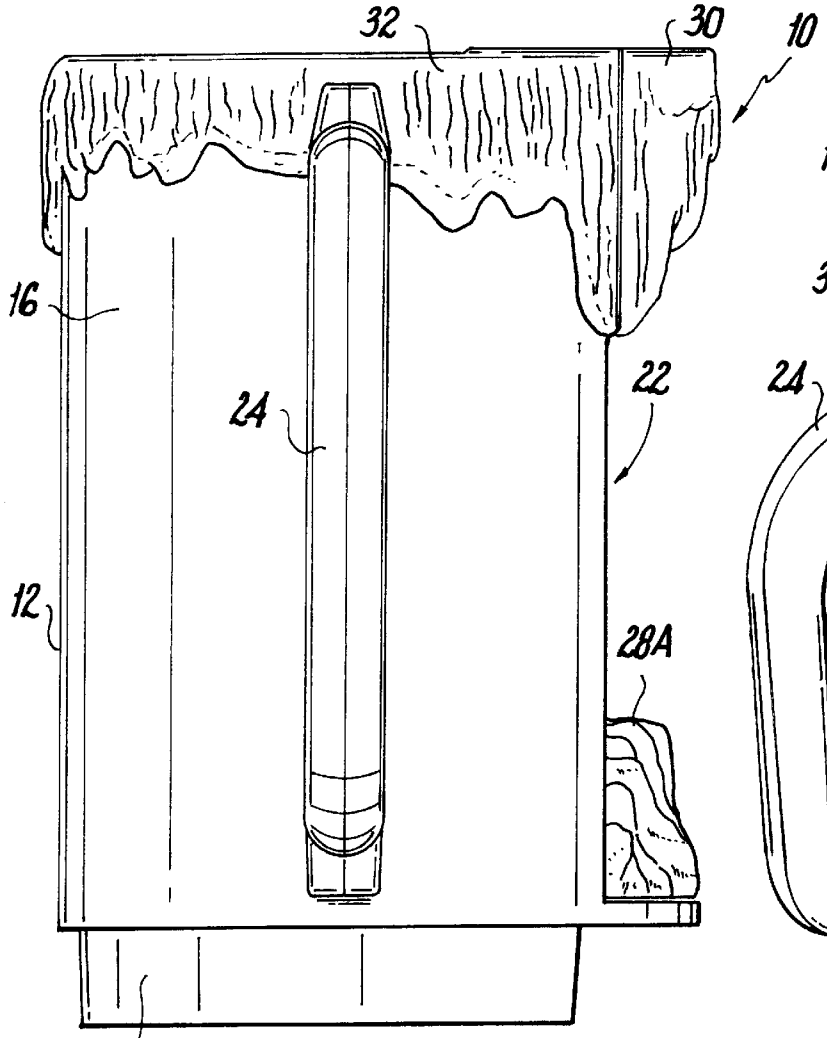
FIG. 4 is a side elevation view of the inventive novelty cup.
Figure 6:
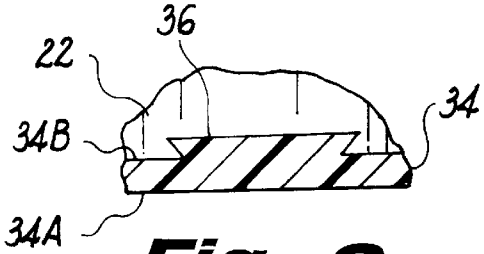
FIG. 6 is a cross sectional elevation view of a base portion of the novelty cup of the present invention, taken along line 6—6 of FIG. 5.
Figure 7:
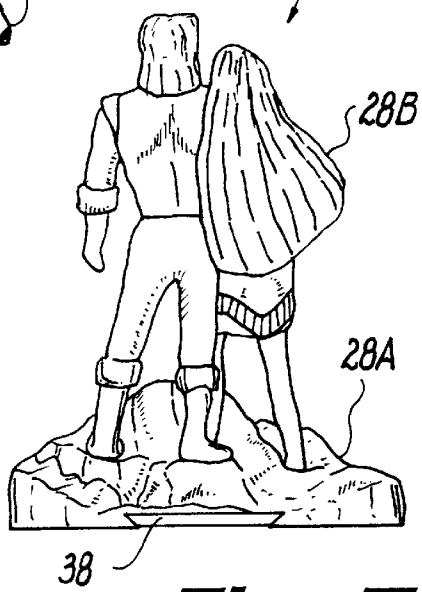
FIG. 7 is a rear elevation view of a scene display feature including a mating portion of the novelty cup of the present invention.

FIGS. 5, 6 and 7 show the selective removability of the scene display 28 from the concavity 22 of the cup 10. Specifically, a dovetail slide arrangement is preferably employed to provide such a feature. The dovetail slide arrangement includes a base portion in the form of a male slide member 36 formed on an upper surface 34B of the bottom wall body 34 and positioned inside the concavity 22, as shown in FIGS. 5 and 6. A mating portion in the form of a female slide member 38 is formed in the rear of the scenery element 28A, as shown in FIG. 7. Accordingly, as illustrated in FIG. 5, the scene display feature 28 selectively slides into the concavity 22 such that the male slide member 36 and the female slide member 38 engage one another. When fitted into the concavity 22, the scene display feature 28 preferably rests against the sidewall body 12 in the back of the concavity 22 such that no substantial portion of the display feature 28 protrudes beyond the area of the bottom wall body 34.

With this engaging arrangement, a user of the cup 10 may remove the scene display feature 28 from the cup. Also, such selective removability makes it possible to interchange a first scene display on the cup with a second scene display. It is to be appreciated that various other types of engaging arrangements for providing selective removability of the scene display feature 28 from the concavity 22 are within the scope of the present invention.

Figure 8:
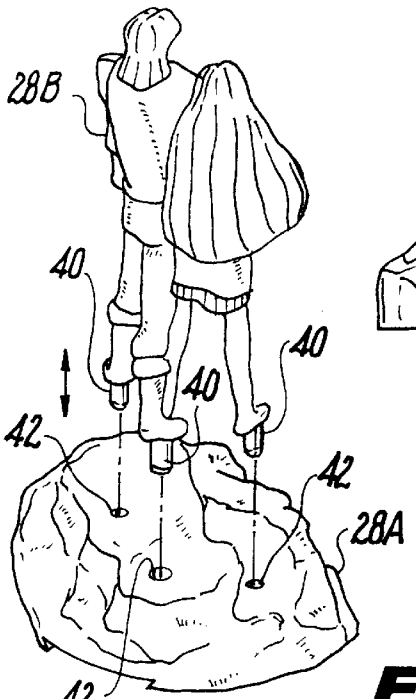
FIG. 8 is a perspective exploded view of the scene display shown in FIG. 7.

Furthermore, not only is the scene display 28 selectively removable from the cup 10, but the FIGS. 28B are also preferably selectively removable from the scenery element 28A, as shown in FIG. 8. Specifically, at least one post 40 is formed in the bottom of the FIGS. 28B, while at least one mating hole 42 is formed in the scenery element 28A. The holes 42 are formed to selectively receive the posts 40. In this manner, the FIGS. 28B and scenery element 28A may be separated from one another so that they may be separately enjoyed or interchanged with other figures and scenery elements.

Figure 9:
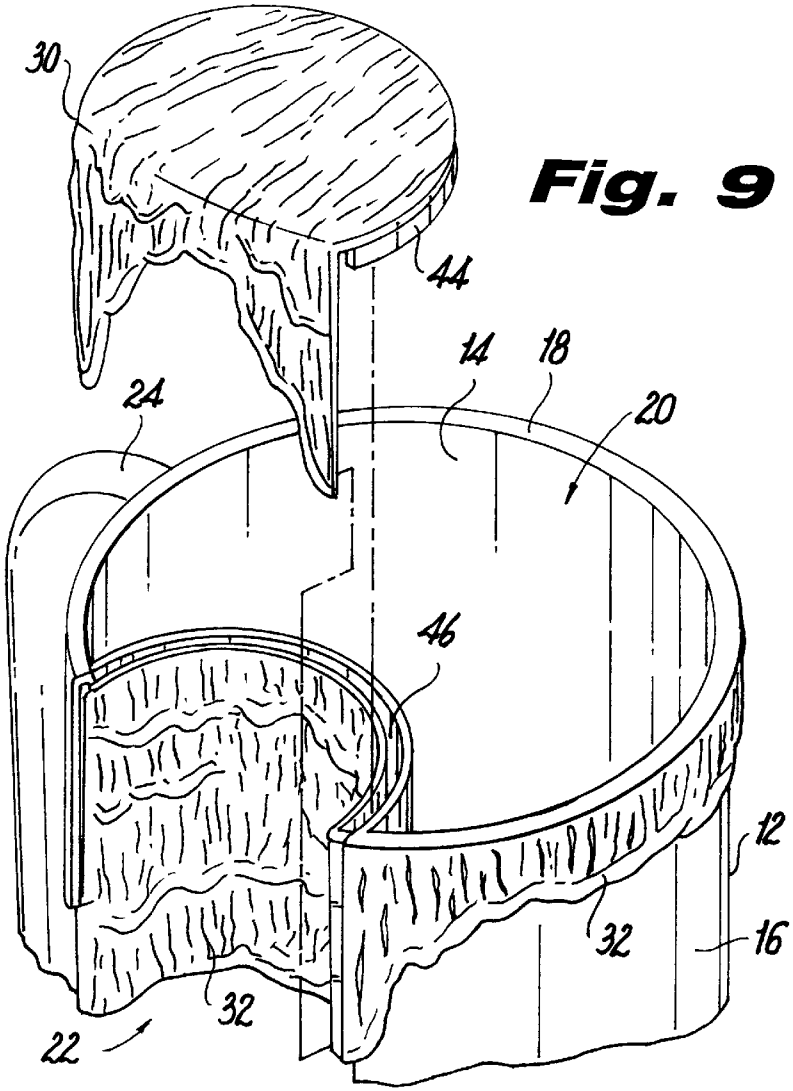
FIG. 9 is a partial perspective exploded view of certain components of the inventive novelty cup.

Similarly, FIG. 9 shows the selective removability of the pictorial portion 30 from the cup 10. Preferably, a tongue and groove arrangement is employed to provide such feature. The pictorial portion 30 preferably has an attachment tongue 44 formed on its underside, as shown in FIG. 9, while a receiving groove 46 is formed on the cup 10. The attachment tongue 44 is substantially circular in nature and similar in shape to the cross-section of the concavity 22. The receiving groove 46 is defined in the upper lip 18 of the sidewall body 12 which extends downward into the sidewall body 12 between the inner surface 14 and the outer surface 16. The width of the receiving groove 46 is sized to be slightly larger than a width associated with the attachment tongue 44 on the pictorial portion 30 so that the two parts fittingly engage one another. The pictorial portion 30 can be permanently fixed to the cup by applying an adhesive to the tongue and groove element. Alternatively, the pictorial portion 30 can be selectively removable to allow a user of the cup 10 to interchange it with an alternative pictorial portion when, for example, the scene display 28 is changed.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A fluid containing device comprising:

(a) an outside wall;

(b) at least one inwardly directed concavity for containing a scene display, the concavity being formed in said outside wall with a base portion having a first mating portion for selectively receiving another mating portion; and (c) a selectively removable scene display having a base portion extending substantially parallel to the concavity base portion wherein at least one component of said scene display is a second mating portion on the display base portion which engages said first mating portion whereby said at least one component of said scene display is selectively fitted in said concavity.

2. The fluid containing device of claim 1 wherein said base portion is one of a male and female dovetail slide member and said mating portion is cooperatively the other of said male and female dovetail slide member.

3. The fluid containing device of claim 1 wherein said scene display includes at least one figure.

4. The fluid containing device of claim 3 wherein said at least one figure is selectively removable from said scene display.

5. The fluid containing device of claim 1 wherein said scene display includes at least one scenery element.

6. The fluid containing device of claim 5 wherein said at least one scenery element is selectively removable from said scene display.

7. The fluid containing device of claim 1 further comprising:

a receiving portion formed in said outside wall; and a pictorial portion having an attachment for selective fixation to said receiving portion.

8. The fluid containing device of claim 7 wherein said receiving portion is one of a tongue member and a groove member and said attachment is alternately the other of said tongue member and said groove member.

9. The fluid containing device of claim 1 further comprising a bottom wall with top and bottom surfaces and wherein said outside wall has inside and outside surfaces, such that said inside surface of said outside wall and said top surface of said bottom wall define a fluid containing area.

10. The fluid containing device of claim 9 further comprising a stand formed on said bottom surface of said bottom wall, said stand being formed to have an outer circumferential shape substantially equivalent to a cross-sectional profile associated with said fluid containing area.

11. The fluid containing device of claim 1 further comprising a fixed pictorial portion formed on said outside wall.

* * * * *